US008541946B2

(12) United States Patent
Eden et al.

(10) Patent No.: US 8,541,946 B2
(45) Date of Patent: Sep. 24, 2013

(54) VARIABLE ELECTRIC FIELD STRENGTH METAL AND METAL OXIDE MICROPLASMA LAMPS AND FABRICATION

(75) Inventors: J. Gary Eden, Champaign, IL (US); Sung-Jin Park, Champaign, IL (US); Jason D. Readle, Channahon, IL (US); Jekwon Yoon, Paju-si (KR); Andrew Price, Savoy, IL (US); Jeffrey Putney, Champaign, IL (US)

(73) Assignee: The Board of Trustees of the University of illinois, Urbana, IL (US)

( * ) Notice: Subject to any disclaimer, the term of this patent is extended or adjusted under 35 U.S.C. 154(b) by 433 days.

(21) Appl. No.: 12/640,884

(22) Filed: Dec. 17, 2009

(65) Prior Publication Data

US 2011/0148282 A1 Jun. 23, 2011

(51) Int. Cl.
*H01J 17/04* (2012.01)

(52) U.S. Cl.
USPC ..... 313/631; 313/491; 313/493

(58) Field of Classification Search
USPC ..... 313/631, 483–486, 492–493, 461, 313/306, 618, 582–587; 445/24–26, 29, 445/46; 315/169.3, 169.4
See application file for complete search history.

(56) References Cited

U.S. PATENT DOCUMENTS

| | | | | |
|---|---|---|---|---|
| 5,441,627 | A | 8/1995 | Kato et al. | |
| 5,445,312 | A * | 8/1995 | Francis | 228/221 |
| 5,982,470 | A * | 11/1999 | Nakahara et al. | 349/153 |
| 6,970,219 | B1 | 11/2005 | Hermann | |
| 7,112,918 | B2 | 9/2006 | Eden et al. | |
| 7,518,119 | B2 * | 4/2009 | Friedman et al. | 250/374 |
| 7,528,804 | B2 * | 5/2009 | Chung et al. | 345/63 |
| RE41,324 | E * | 5/2010 | Fujii et al. | 349/149 |
| 2002/0030437 | A1 * | 3/2002 | Shimizu et al. | 313/495 |
| 2002/0175623 | A1 * | 11/2002 | Kim et al. | 313/585 |
| 2003/0080688 | A1 | 5/2003 | Eden et al. | |

(Continued)

FOREIGN PATENT DOCUMENTS

| | | |
|---|---|---|
| KR | 10-2005-0113533 | 12/2005 |
| WO | WO 2007/011865 | 1/2007 |
| WO | WO 2007/087371 | 8/2007 |
| WO | WO 2008/013820 | 1/2008 |

OTHER PUBLICATIONS

Jessensky, O., et. al., "Self-organized formation of hexagonal pore arrays in anodic aluima", *Applied Physics Letters*, vol. 72, No. 10, Mar. 9, 1998.

(Continued)

*Primary Examiner* — Anh Mai
*Assistant Examiner* — Fatima Farokhrooz
(74) *Attorney, Agent, or Firm* — Greer, Burns & Crain Ltd.

(57) ABSTRACT

Preferred embodiments of the invention provide microcavity plasma lamps having a plurality of metal and metal oxide layers defining a plurality of arrays of microcavities and encapsulated thin metal electrodes. Packaging encloses the plurality of metal and metal oxide layers in plasma medium. The metal and metal oxide layers are configured and arranged to vary the electric field strength and total gas pressure (E/p) in the lamp. The invention also provides methods of manufacturing a microcavity plasma lamp that simultaneously evacuate the volume within the packaging and a volume surrounding the packaging to maintain an insignificant or zero pressure differential across the packaging. The packaging is backfilled with a plasma medium while also maintaining an insignificant or zero pressure differential across the packaging.

30 Claims, 6 Drawing Sheets

(56) References Cited

U.S. PATENT DOCUMENTS

| | | | | |
|---|---|---|---|---|
| 2006/0082319 | A1* | 4/2006 | Eden et al. | 315/169.3 |
| 2006/0284558 | A1 | 12/2006 | Kwon et al. | |
| 2007/0108906 | A1 | 5/2007 | Kang et al. | |
| 2007/0170866 | A1* | 7/2007 | Eden et al. | 313/631 |
| 2007/0200499 | A1 | 8/2007 | Eden et al. | |
| 2007/0236146 | A1* | 10/2007 | Kang et al. | 313/585 |
| 2008/0185579 | A1* | 8/2008 | Eden et al. | 257/43 |
| 2009/0295288 | A1* | 12/2009 | Eden et al. | 313/582 |

OTHER PUBLICATIONS

Kim, K.S., et. al. "Self-patterned aluminum interconnects and ring electrodes for arrays of microcavity plasma devices encapsulated in $Al_2O_3$", J.Phys.D: Appl. Phys., vol. 41,2008.

Kim, Sung O., et. al., "Arrays of Mircoplasma Devices Fabricated in Photodefinable Glass and Excited AC or DC by Interdigitated Electrodes", *IEEE Photonics Technology Letters*, vol. 17, No. 7, Jul. 2005.

Masuda, Hideki, et. al., "Ordered Metal Nanohole Arrays Made by a Two-Step Replication of Honeycomb Structures of Anodic Alumina", *Science*, vol. 268, Jun. 9, 1995.

Park, S.-J. et. al., "Flexible microdischarge arrays: Metal/polymer devices", *Applied Physics Letters*, vol. 77, No. 2, Jul. 10, 2000.

Park, S.-J., et. al., "Performance of Microdischarge Devices and Arrays with Screen Electrodes", *IEEE Photonics Technology Letters*, vol. 13, No. 3, Jan. 2001.

Park, S.-J., et. al., "Microdischarge Arrays: A New Family of Photonic Devices", *IEEE Journal on Selected Topics in Quantum Electronics*, vol. 8, No. 1, Jan./Feb. 2002.

Park, S-J., et. al., "40 000 pixel arrays of ac-excited silicon microcavity plasma devices", *Applied Physics Letters*, 88, 111501, 2005.

White, A.D., "New Hollow Cathode Glow Discharge", *Journal of Applied Physics*, vol. 30, No. 3, May 1959.

Park, S-J., et. al., "Lighting from thin (<1mm) sheets of microcavity plasma arrays fabricated in $Al/Al_2O_3$/glass structures: planar, mercury-free lamps with radiating areas beyond 200 $cm^2$", *Journal of Applied Physics*, 40 (2007) 3907-3913, Jun. 15, 2007.

* cited by examiner 10
13a
15a
16
12
17
20
26
15b
22
13b
24
26
18
20
12
19
22
15b 17
19
18

VARIABLE ELECTRIC FIELD STRENGTH METAL AND METAL OXIDE MICROPLASMA LAMPS AND FABRICATION

STATEMENT OF GOVERNMENT INTEREST

This invention was made with Government assistance under U.S. Air Force Office of Scientific Research grant Nos. F49620-03-1-0391 and AF FA9550-07-1-0003. The Government has certain rights in this invention.

FIELD OF THE INVENTION

The invention is in the field of microcavity plasma devices, also known as microdischarge devices or microplasma devices.

BACKGROUND

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Such high pressure operation is advantageous. An example advantage is that, at these higher pressures, plasma chemistry favors the formation of several families of electronically-excited molecules, including the rare gas dimers ($Xe_2$, $Kr_2$, $Ar_2$, . . . ) and the rare gas-halides (such as XeCl, ArF, and $Kr_2F$) that are known to be efficient emitters of ultraviolet (UV), vacuum ultraviolet (VUV), and visible radiation. This characteristic, in combination with the ability of microplasma devices to operate in a wide range of gases or vapors (and combinations thereof), offers emission wavelengths extending over a broad spectral range. Furthermore, operation of the plasma in the vicinity of atmospheric pressure minimizes the pressure differential across the packaging material when a microplasma device or array is sealed.

Research by the present inventors and colleagues at the University of Illinois has resulted in new microcavity plasma device structures as well as applications. As an example, semiconductor fabrication processes have been adapted to produce large arrays of microplasma devices in silicon wafers with the microcavities having the form of an inverted pyramid. Arrays with 250,000 devices, each device having an emitting aperture of 50×50 $\mu m^2$, have been demonstrated with a device packing density and array filling factor of $10^4$ $cm^{-2}$ and 25%, respectively. Other microplasma devices have been fabricated in ceramic multilayer structures, photodefinable glass, and $Al/Al_2O_3$ structures.

Microcavity plasma devices developed over the past decade have a wide variety of applications. An exemplary application for a microcavity plasma device array is to a display. Since the diameter of single cylindrical microcavity plasma devices, for example, is typically less than 200-300 μm, devices or groups of devices offer a spatial resolution that is desirable for a pixel in a display. In addition, the efficiency of a microcavity plasma device can exceed that characteristic of conventional plasma display panels, such as those in high definition televisions.

Early microcavity plasma devices exhibited short lifetimes because of exposure of the electrodes to the plasma and the ensuing damage caused by sputtering. Polycrystalline silicon and tungsten electrodes extend lifetime but are more costly materials and difficult to fabricate.

Large-scale manufacturing of microcavity plasma device arrays benefits from structures and fabrication methods that reduce cost and increase reliability. Of particular interest in this regard are the electrical interconnections between devices in a large array. If the interconnect technology is difficult to implement or if the interconnect pattern is not easily reconfigurable, then manufacturing costs are increased and potential commercial applications may be restricted. Such considerations are of increasing importance as the demand rises for displays or light-emitting panels of larger area.

Previous work conducted by some of the present inventors has resulted in thin, inexpensive metal/metal oxide arrays of microcavity plasma devices. Metal/metal oxide lamps are formed from thin sheets of oxidized electrodes, are simple to manufacture and can be conveniently formed by mass production techniques such as roll-to-roll processing. In some manufacturing techniques, the arrays are formed by oxidizing a metal screen, or other thin metal sheet having cavities formed in it, and then joining the screen to a common electrode. The metal/metal oxide lamps are light, thin, and can be flexible. While individual arrays can be joined with other arrays to form larger arrays, rapidly fabricating individual arrays having radiating areas that exceed approximately 100 $cm^2$ is challenging. As arrays become larger, avoiding stress that can reduce the flatness of the array is of increasing importance.

Eden et al. U.S. Pat. No. 7,385,350, entitled "Arrays of Microcavity Plasma Devices with Dielectric Encapsulated Electrodes," which issued on Jun. 10, 2008, discloses arrays of microcavity plasma devices with dielectric encapsulated electrodes. A pattern of microcavities is produced in a metal foil, or the metal foil can be a pre-formed metal screen. Oxide is subsequently grown on the foil and within the microcavities (where plasma is to be produced) to protect the microcavity from the plasma and electrically isolate the foil. A second metal foil is also encapsulated with oxide and is bonded to the first encapsulated foil. A thin glass layer or vacuum packaging, for example, is able to seal the plasma medium into the array. The second electrode can be a solid sheet common electrode, which requires no particular alignment, or can be a patterned electrode, which requires alignment with the first electrode.

SUMMARY OF THE INVENTION

Preferred embodiments of the invention provide microcavity plasma lamps having a plurality of metal and metal oxide layers defining a plurality of arrays of microcavities and encapsulated thin metal electrodes. Packaging encloses the plurality of metal and metal oxide layers in plasma medium. The metal and metal oxide layers are configured and arranged to vary the electric field strength and total gas pressure (E/p) in the lamp. The invention also provides methods of manufacturing a microcavity plasma lamp that simultaneously evacuate the volume within the packaging and a volume surrounding the packaging to maintain an insignificant or zero pressure differential across the packaging. The packaging is backfilled with a plasma medium while also maintaining an insignificant or zero pressure differential across the packaging.

DETAILED DESCRIPTION OF THE PREFERRED EMBODIMENTS

Preferred embodiments of the invention provide microcavity plasma lamps having a plurality of metal and metal oxide layers defining a plurality of arrays of microcavities and encapsulated thin metal electrodes. Packaging encloses the plurality of metal and metal oxide layers in plasma medium. The metal and metal oxide layers are configured and arranged to vary the electric field strength and total gas pressure (E/p) in the lamp. The invention also provides methods of manufacturing a microcavity plasma lamp that simultaneously evacuate the volume within the packaging and a volume surrounding the packaging to maintain an insignificant or zero pressure differential across the packaging. The packaging is backfilled with a plasma medium while also maintaining an insignificant or zero pressure differential across the packaging.

The invention provides high efficiency arrays of microcavity plasma devices including plural thin sheets of metal/metal oxide electrodes with associated microcavities. Arrays of the invention produce emissions from both the front and back sides of the array, and are especially well-suited for general lighting applications that can benefit greatly from high efficiency performance.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize broader aspects of the invention.

Figures 1A, 1B:
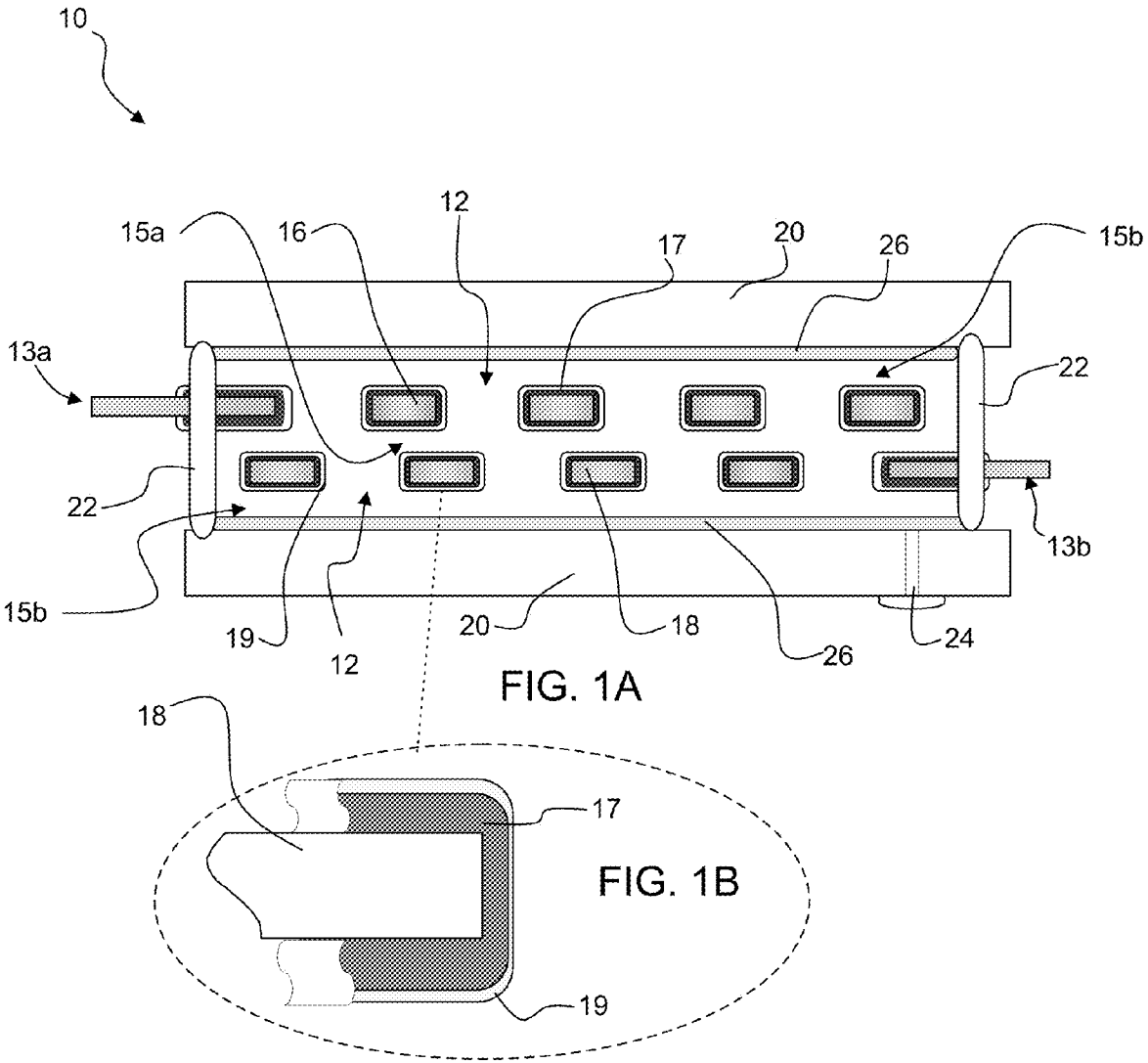
FIG. 1A is a schematic cross-sectional view of an exemplary embodiment array of microcavity plasma devices of the invention.
FIG. 1B is a schematic cross-section of a portion of one of the electrodes of the array.

FIG. 1A is a cross-sectional diagram of an example embodiment of a microcavity plasma lamp 10 of the invention, and FIG. 1B is an expanded cross-section of a portion of one of the electrodes of the array 10. An array of microcavities 12 are defined in first and second thin suspended and intentionally staggered metal oxide sheets 13*a* and 13*b*. The metal oxide sheets 13*a* and 13*b* are suspended, meaning that they are separated from each other and/or from above and below with a small gaps 15*a* and 15*b*. The metal oxide sheets 13*a* and 13*b* are staggered, such that microcavities 12 defined by the sheet 13*a* are offset from microcavities formed by the sheet 13*b*. The thin metal oxide sheets 13*a* and 13*b* can be formed when a thin metal foil, mesh, or screen with preformed cavities is electrochemically anodized to convert the metal surface into metal oxide. Preferred metal and metal oxide is aluminum and aluminum oxide, respectively. Other metals and metal oxides, e.g., titanium and its oxide, can also be used.

Other methods of coating thin screens or foils having microcavities can also be used, but the anodization process is a simple and preferred method for manufacturing metal/metal oxide electrode layers 13*a* and 13*b*.

Metal electrodes 16, 18 are encapsulated in metal oxide 17 as a result of the anodization, which protects the electrodes 16, 18 from plasma produced within the microcavities 12, thereby promoting the lifetime of the array 10, and electrically insulating the electrodes 16, 18. The intentional staggering of the microcavities 12 in the lamp 10 provides an advantage in terms of efficiency by varying the ratio of the electric field strength and total gas pressure (E/p, where E is the electric field strength and p is the total gas pressure) in a periodic manner throughout the lamp. The suspension of the sheets 13*a* and 13*b* permits small microplasmas to form above and below the sheets 13*a* and 13*b* in addition to forming in the microcavities 12. The small micro plasmas that form above and below the sheets 13*a* and 13*b* also have an E/p that is different from that in the microcavities. This permits design flexibility in varying E/p (accomplished by selecting gaps and offsets) which is a valuable mechanism (by which radiative efficiency of the lamp 10 can be optimized. Gaps 15*a* between electrodes 13*a* and 13*b* are capable of producing plasma that efficiently generates ultraviolet light. The gap between layers 13*a* and 13*b* can be maintained without spacers when the layers 13*a* and 13*b* have sufficient stiffness to be supported in a stable fashion when supported solely at one end. Alternatively, small dielectric, (e.g., glass) spacers (not shown in FIG. 1A) can be used between the layers 13*a* and 13*b*. The staggering and separation of the layers 13*a* and 13*b* creates multiple distances between portions of the electrodes 16 and 18. Various electric field strengths form around portions of the electrodes 16 and 18 to create varying E/p.

FIG. 1B illustrates that an additional thin layer of dielectric 19 can be deposited onto the metal oxide dielectric 17. A preferred additional layer of dielectric 19 is a thin glass layer, which can be formed by deposition of a thin layer of glass onto the metal oxide layer 17 by a sol-gel process. Dielectric layer 19 is desirable if the growth of metal oxide layer 17 along the surface of electrode 18 and into the cavities 12 results in excessive stress and micro-cracking in oxide layer 17. The degree of micro-cracking is dependent upon processing conditions and the radius of curvature of the metal oxide layer 17 as it "turns the corner" into the microcavities. In this situation, dielectric layer 19 can be helpful in filling microcracks.

Gas(es), vapor(s) or a combination thereof are sealed in the microcavities 12 by packaging layers 20, such as glass or plastic. The packaging layers are spaced apart and sealed by spacers 22, by which the gaps 15*a* and 15*b* are set and by which the metal oxide layers 13*a* and 13*b* are suspended from their ends. A thickness T of the array in preferred embodiments is in the approximate range of 0.5-5.0 mm. Portions of the electrodes 16, 18 are illustrated as extending outside the spacers 22, which can seal to the electrodes. The extension can provide for electrical connection to the electrodes. Application of an appropriate time-varying voltage between electrodes 16 and 18 will ignite plasmas in all of the microcavities 12, and also in the gap regions 15*a*, 15*b*. A voltage differential in the gaps 15*b* during positive half-cycles is the result of negative charge build on surfaces opposing the layers 13*a*, 13*b* (in this instance, a phosphor layer 26). The wavelength of the plasma emissions can be tailored using different gas(es) and/or vapor(s) in the array. A port 24 can be used to evacuate and fill the array 10, and can be sealed once the array is filled with the desired gas/vapor mixture.

If the gas(es) introduced to array 10 of FIG. 1A emit ultraviolet light when excited in a microplasma, then visible light of the desired color(s) can be produced by coating the interior walls of the lamp structure with phosphor 26. This can be done, for example, by screen printing. Although a phosphor layer is shown in FIG. 1A only on the interior structures of packaging layers 20, the metal oxide sheets 13*a* and 13*b* may also be coated with phosphor.

In several preferred embodiments of the invention, the packaging layers 20 are glass sheets typically 50 μm-2 mm in thickness. Such sheets can be bonded to the spacers 22 by a sealant such as glass frit. Since the total pressure of the gas(es) in array 10 is on the order of one atmosphere, the pressure differential across the packaging layers 20 is small, and so the array 10 can also be sealed with packaging layers 20 that are thin sheets of plastic. In this embodiment, the spacers 22 may not be necessary and the plastic packaging layers can be sealed directly to one another by any of several methods well known in the art.

The array 10 of FIGS. 1A and 1B provides emissions from both its front and back sides, which is well-suited for many illumination applications. Because patterns comprising phosphors 26 emitting various colors can be screen printed onto the interior surface of packaging layers 20, the lamp design of FIG. 1A is also well-suited for signage, or custom control of the color of the light emitted by the lamp. The particular gas(es) and/or (vapors) sealed in the microcavities 12 can also control the wavelength of emissions produced by the array 10.

Figure 2:
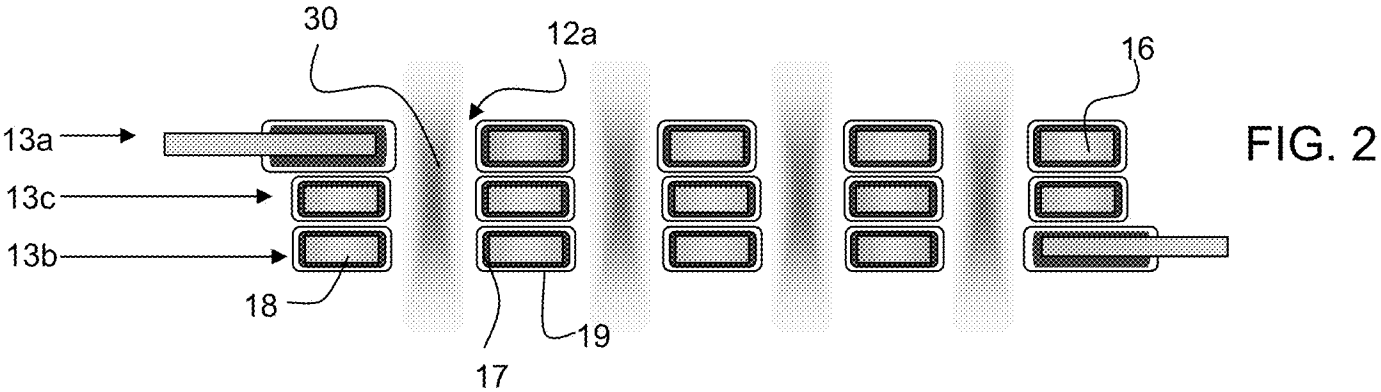
FIG. 2 is a schematic cross-sectional view of a portion of another exemplary embodiment array of microcavity plasma devices of the invention.
Figure 3:
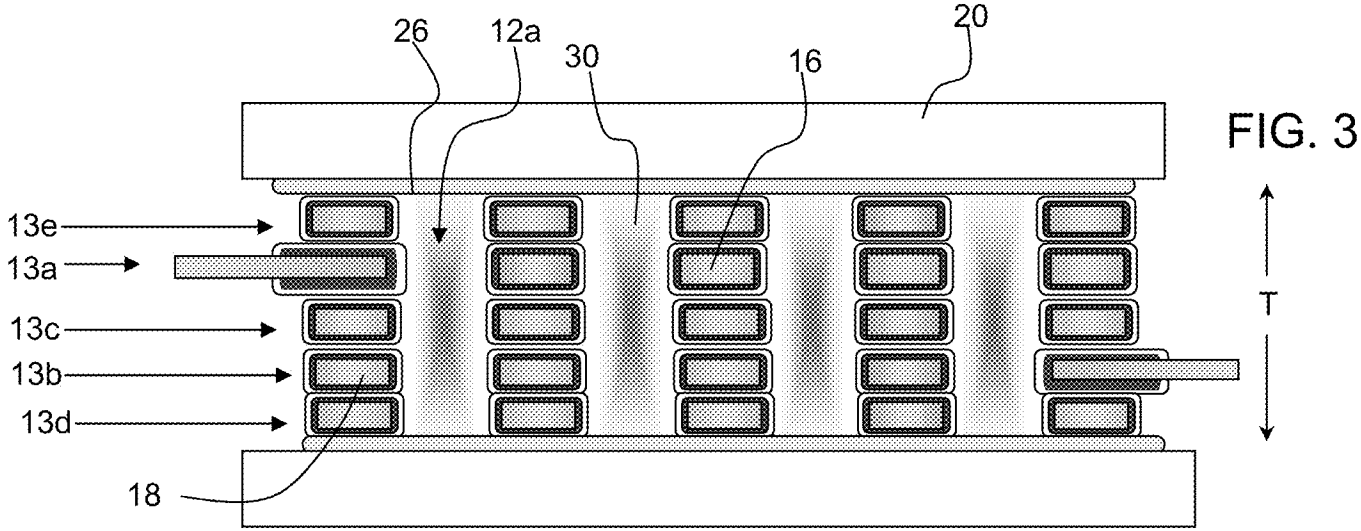
FIG. 3 is a schematic cross-sectional view of another exemplary embodiment array of microcavity plasma devices of the invention.

FIGS. 2 and 3 illustrate additional embodiments that use non-powered, additional thin metal/metal oxide layers 13*c*, 13*d*, 13*e* as spacers for the electrode metal/metal oxide layers 13*a*, 13*b* and with microcavities in the different layers aligned to form extended microcavities 12*a* that will form an extended microplasma during operation. In FIG. 2, which shows only the metal/metal oxide layers, a third metal oxide layer 13*c* with microcavities serves as a spacer. In FIG. 3, plasma 30 that is formed is longer than that in the FIG. 1A embodiment, and the use of spacer layers permits the length of the plasma 30 to be tailored. The length of the plasma 30 can impact favorably the UV/visible emission efficiency and use of spacing layers permits the plasma length to be adjusted from one array design to another. The primary benefit of the non-driven electrodes spacers 13*c* in FIGS. 2 and 13*c*, 13*d*, and 13*e* in FIG. 3 is that they appear to assist in the dissipation of charge built up on the metal oxide dielectric. Experiments show these spacers to be beneficial with regard to light emission efficiency but their function appears to be much more than serving simply as a physical spacer.

In the illustrated embodiments, each of the layers 13*a*, 13*b*, 13*c*, 13*d*, 13*e* can be formed from anodized screens where the holes in the screens constitute the microcavities. However, the spacer screen layers 13*c*, 13*d*, 13*e* that don't serve as electrodes are not necessarily anodized. The inclusion of a number of metal oxide layers as spacer layers has only a negligible effect on the overall thickness of the microcavity plasma device arrays, but the spacer layers are beneficial to efficiency for reasons that are not yet completely understood. The thickness T of the multiple layers 13*a*, 13*b*, 13*c*, 13*d*, 13*e* in FIG. 3 can be, for example, in the approximate range of only 0.25-0.38 mm. In another preferred embodiment, the metal/metal oxide layers 13*a*-13*e* in FIGS. 2 and 3 are staggered as in the FIGS. 1A and 1B embodiment for the purpose of tailoring the E/p ratio.

Figure 4:
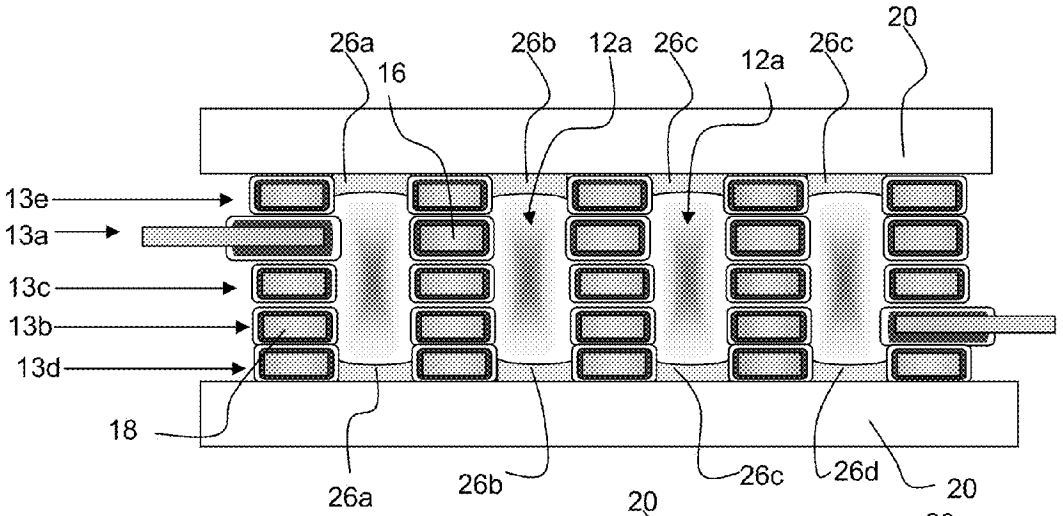
FIG. 4 is a schematic cross-sectional view of another exemplary embodiment array of microcavity plasma devices of the invention.

In the embodiment of FIG. 4, separate phosphors 26*a*, 26*b*, 26*c*, and 26*d* are deposited onto the interior surfaces of packaging layers 20 in such a way that a different phosphor is associated with each separate extended microcavity formed by the alignment of microcavities in the multiple layers 13*a*, 13*b*, 13*c*, 13*d*, 13*e*. In this embodiment, the microcavities of the individual layers are aligned and the choice of phosphors determines the color perceived by the eye of an observer viewing the array lamp 10 from either side.

Figure 5:
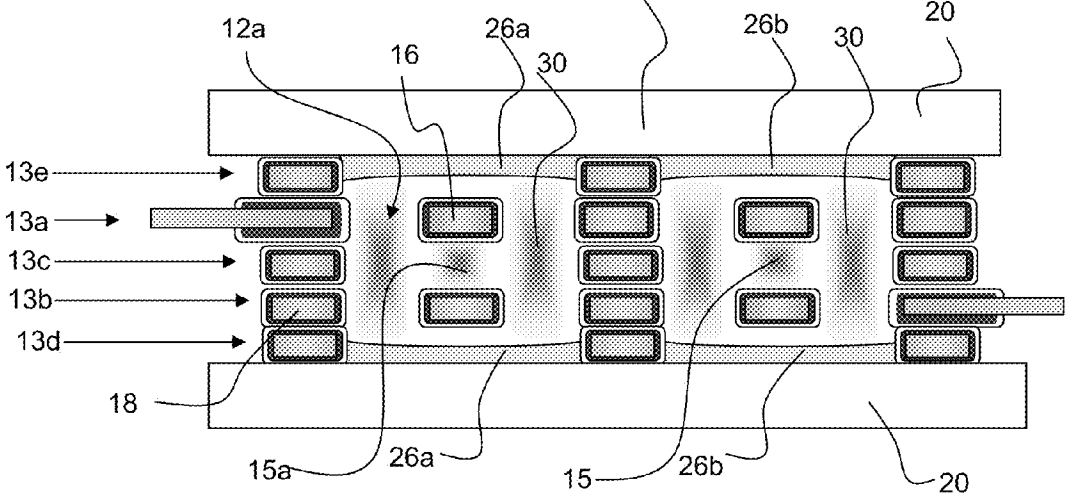
FIG. 5 is a schematic cross-sectional view of another exemplary embodiment array of microcavity plasma devices of the invention.

The embodiment of FIG. 5 achieves the generation of plasmas of differing lengths by varying the microcavity spacing among the metal/metal oxide layers 13*a*-13*e*. In the specific instance of FIG. 5, the microcavity spacing is the same for the electrodes 13*a* and 13*b* but is significantly smaller than that for layers 13*c*, 13*d*, and 13*e*. A similar effect can be realized by varying the sizes of the microcavities in the individual metal/metal oxide layers 13*a*-13*e*. As with the FIGS. 1A and 1B embodiment, microplasma formed in the gaps 15 between the layers 13*a* and 13*b* will have a different E/p ratio than microplasma formed in the extended microcavities 12*a* adjacent the gap areas. Extended microplasma is formed in the extended microcavities 12*a* in areas where the individual microcavities align, while shorter microplasmas form in the gaps 15 between sheets 12*a* and 13*b* adjacent to the extended microplasmas. Phosphors 26*a* and 26*b* are also incorporated into this embodiment.

Figure 6:
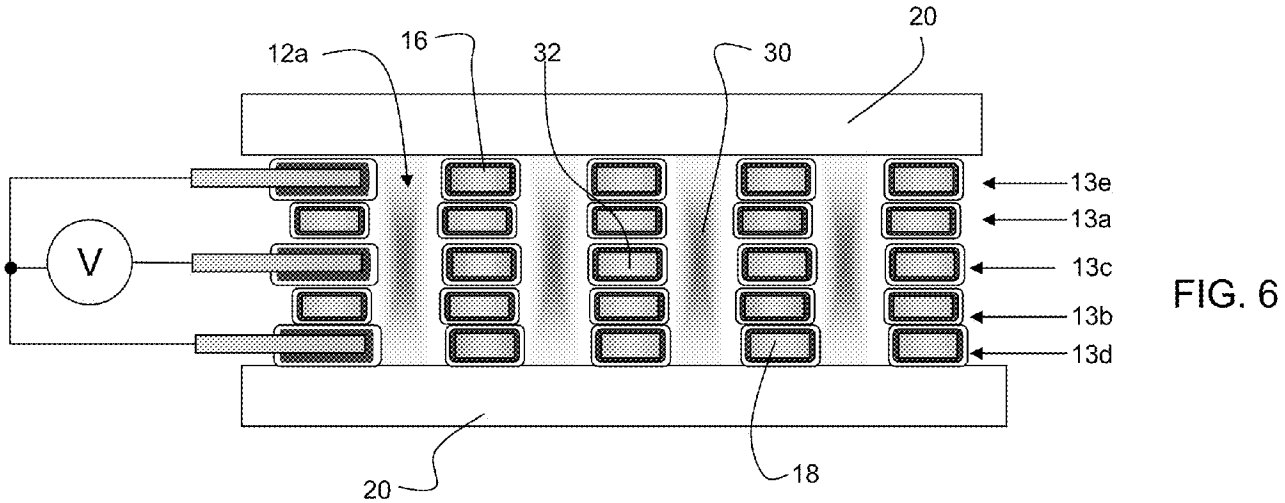
FIG. 6 is a schematic cross-sectional view of another exemplary embodiment array of microcavity plasma devices of the invention.

In the embodiment of FIG. 6 there is an additional common electrode 32 that is shared by the electrodes 16 and 18. This is one alternative for electrically driving the array, and other possibilities include driving sets of electrodes out of phase with respect to another set. Generally, the multiple layer metal/metal oxide structure allows considerable flexibility in optimizing the optical efficiency for a given optical radiator (i.e., atom or molecule) while still offering a thin, lightweight structure and providing options for achieving a desired E/p ratio throughout the lamp or multiple E/p ratios in different regions of the lamp.

Figure 7:
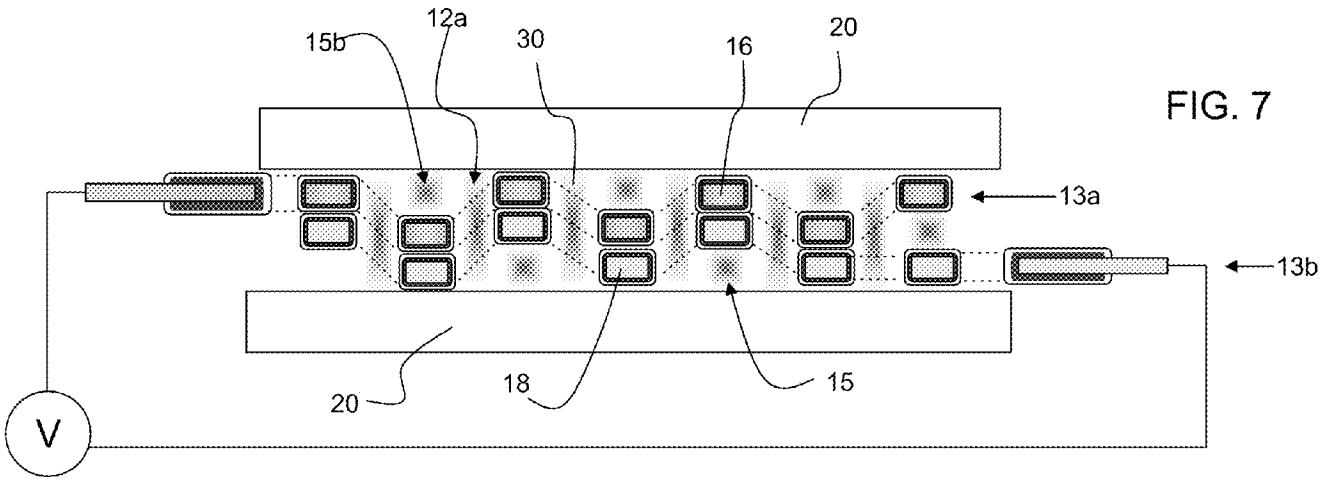
FIG. 7 is a schematic cross-sectional view of another exemplary embodiment array of microcavity plasma devices of the invention.

FIG. 7 is a cross-sectional diagram for an additional embodiment of the invention that achieves a periodic variable E/p ratio throughout the lamp. The lamp structure of FIG. 7 has the encapsulated electrodes 16, 18 fabricated from mesh or screen that has been extruded, yielding a modulated contour for the electrodes 16, 18 that approximates a triangular wave, though extrusion can produce other modulated shapes. This creates an alternating pattern of extended microcavities 12*a* that generate microplasmas and smaller microplasmas formed in gaps 15*b* between the electrodes 16, 18 and the packaging windows 20. Negative charge build up occurs on the inside of the windows 20, and when the opposing electrode is in a positive half cycle this can generate a plasma in the gaps 15*b*. Although no phosphor is shown in FIG. 7 and it should be mentioned that, as described elsewhere, phosphor coatings can be applied to the interior surfaces of both windows 20 of FIG. 7 and coated onto the electrodes 13*a* and 13*b* as well. The geometry of this system varies E/p spatially in the lamp but does so in a manner that optimizes the light transmission of the electrode stack.

Figure 8:
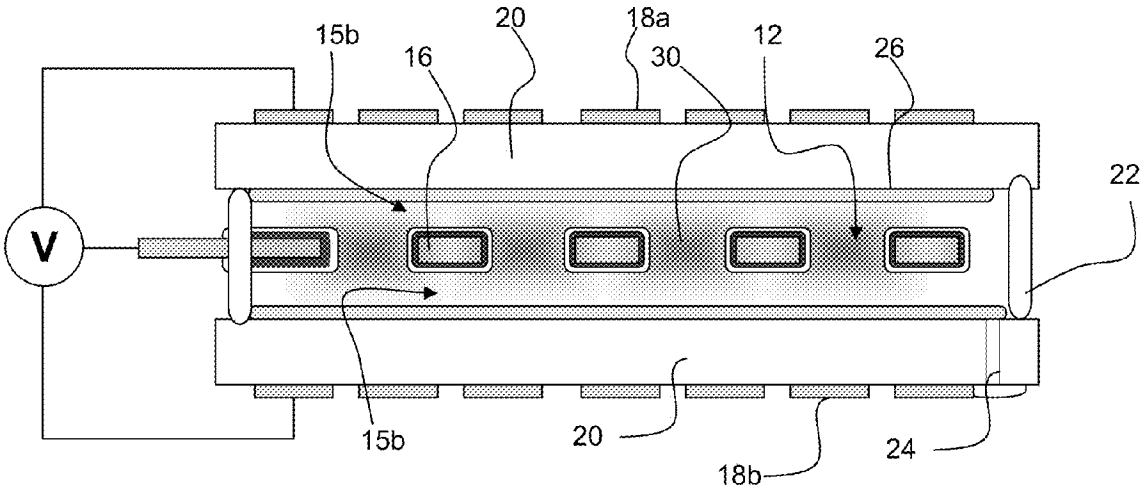
FIG. 8 is a schematic cross-sectional view of an exemplary embodiment array of microcavity plasma devices of the invention.
Figure 9:
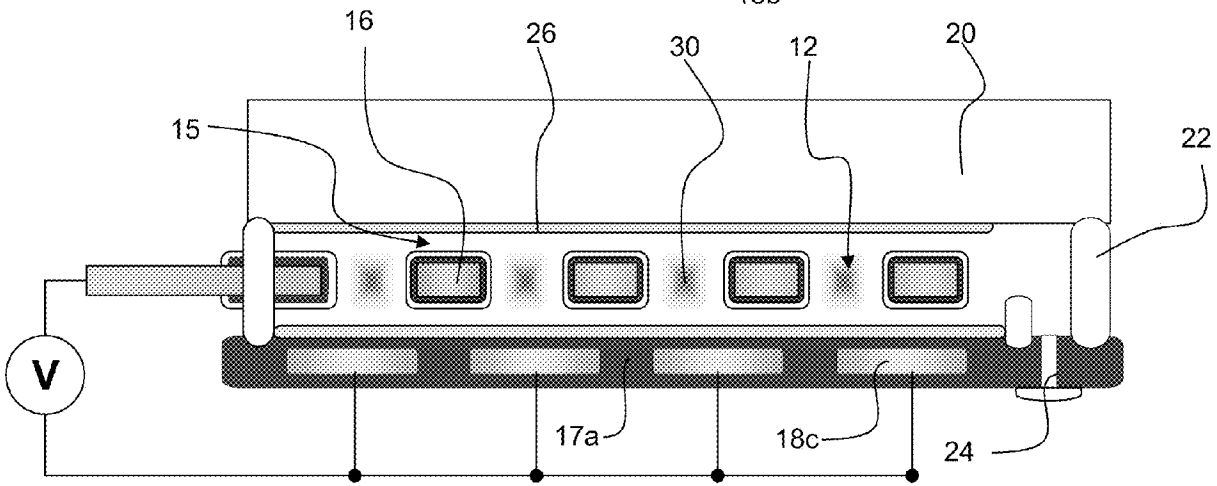
FIG. 9 presents luminous efficacy data obtained with a prior device that hand a single metal/metal oxide layer with microcavities and a continuous metal electrode surrounded by oxide.

FIGS. 8 and 9 illustrate two additional embodiments that place an electrode for the array outside or within one of the packaging layers. In FIG. 8, transparent second electrodes 18*a*, 18*b* are disposed externally on the packaging layers 20. In the FIGS. 8 and 9 embodiments, the electrode 16 is suspended within the packaging as in FIGS. 1A and 1B to create areas of variable E/p ratio by virtue of the microcavities 12 and gaps 15*b*. As one example, indium tin oxide (ITO) pads or strip electrodes can be produced by evaporative or deposition processes. If the microplasmas emit in the UV, phosphors layer 26 is again provided to produce the desired visible color(s). In FIG. 9, one part of the packaging layer includes encapsulated second electrodes 18*c*, which are preferably metal electrodes encapsulated in metal oxide 17*a*. Alternatively, electrodes 18 can be metal films deposited within slots or cavities etched into glass sheet 17*a*. Rather than connecting all encapsulated electrodes 18*c* to the same terminal of the voltage source, one can drive each electrode with a different (independent) voltage source, thereby allowing for each microcavity to be addressed separately. Additionally, either of the FIGS. 8 and 9 designs can be modified by using multiple metal/metal oxide layers to extend the plasma as in FIGS. 2-6 and to provide different E/p ratio profiles that vary through the lamp.

Figure 10A:
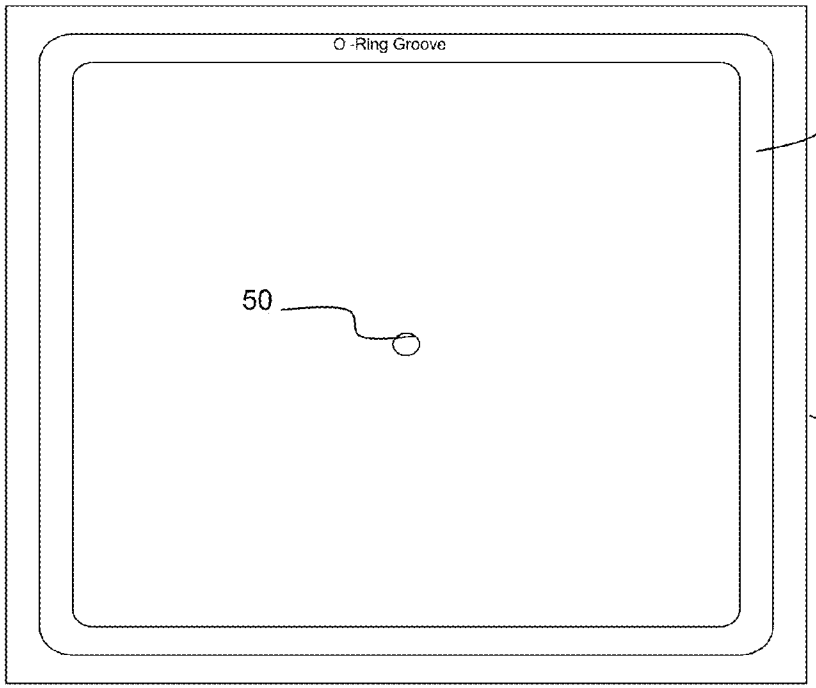
FIGS. 10A and 10B illustrate a preferred embodiment vacuum processing system for manufacturing arrays of microcavity plasma devices of the invention.
Figure 10B:
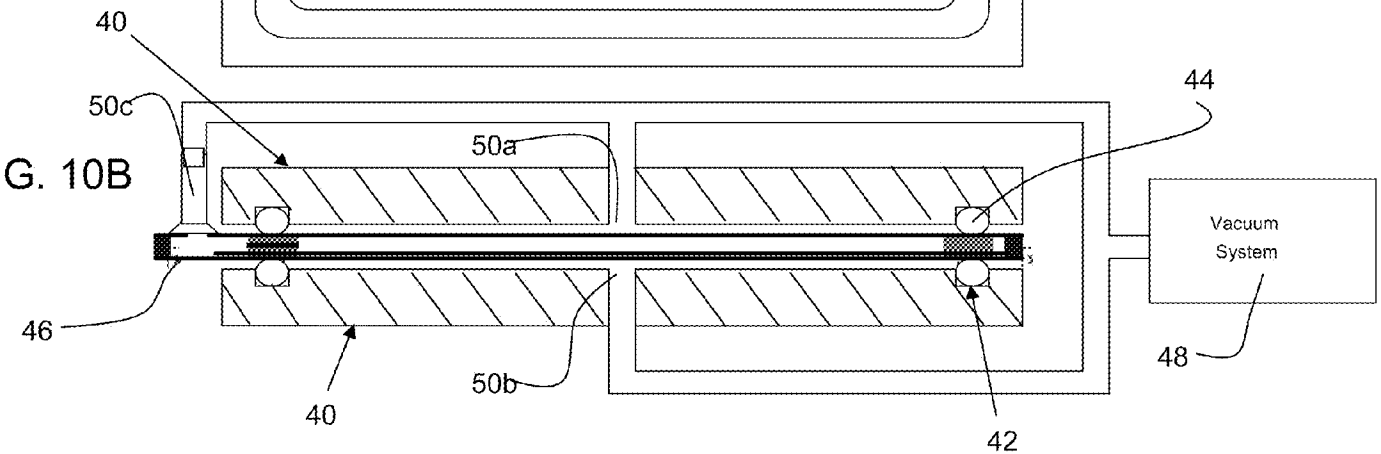

During manufacture of the devices of the invention, it is important to maintain the flatness and alignment of the thin layers 13*a*-13*e* as the device assembly is finalized. In the case of the extruded embodiment of FIG. 7, the flatness can be considered to be the outermost surfaces (the surfaces opposite the packaging layers) of the layers 13*a* and 13*b*. This can become difficult as the size of the array is extended to 1 $ft^2$ and beyond. FIGS. 10A and 10B illustrate a preferred embodiment vacuum processing system for manufacturing arrays of microcavity plasma devices of the invention. This system is a two-sided metal clamp designed to hold the array assembly as it is being evacuated and backfilled with the desired gases and/or vapors. FIG. 10B is a cross-sectional diagram of the clamp, which includes two stainless-steel plates 40, each with an O-ring groove 42 machined into it. FIG. 10A shows one of the metal plates 40 of FIG. 10B in plan view. An O-ring 44 seated in each of the O-ring grooves makes a vacuum tight seal with the external surface of array structure 46. The seals are made near the perimeter of array 46, at or near the location of either the spacers 22 or where the packaging layers 20 are sealed. A vacuum/gas handling system 48 evacuates the interior and exterior of the lamp through least 3 ports 50*a*, 50*b*, and 50*c*. Port 50*c* accesses the interior of the lamp 46 and ports 50*a* and 50*b* provide access to the air immediately outside the lamp, so that the system of FIGS. 10A and 10B can evacuate the interior of the lamp while simultaneously evacuating the air outside the lamp. Therefore, an significant (or zero) pressure difference is maintained while the lamp is evacuated, outgassed, and (subsequently) back-filled with the desired gas or gas mixture. Once finished, the lamp will, as mentioned earlier, have gas at atmospheric pressure within the lamp and without, thus producing little stress on the packaging material. However, the device of FIG. 10 is required to ensure that the lamp array is not damaged during processing. Specifically, the central vacuum ports 50*a*. 50*b* in the plates 40 provide evacuation of the air outside of the array defined in a chamber that is sealed by the O-rings 44. This pressure is then equalized to the pressure inside the array as the array is filled with gases or vapors used for plasma generation. This technique ensures that the packaging layers 20 and materials used to obtain a seal of the packaging layer are not stressed while the array is evacuated and then filled with the appropriate gas or gas mixture.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

The invention claimed is:

1. A microcavity plasma lamp, comprising:

a first metal and metal oxide layer defining a first array of microcavities and an oxide encapsulated first thin metal electrode;

a second metal and metal oxide layer defining a second array of microcavities and an oxide encapsulated second thin metal electrode, said second metal and metal oxide layer being separated from said first metal and metal oxide layer such that there is no direct physical contact between first and second metal and metal oxide layers;

a packaging containing said first and second metal and metal oxide layers; and plasma medium contained within said packaging; wherein said first and second metal and metal oxide layers are configured and arranged to create a varying ratio of electric field strength and total gas pressure (E/p) between the first and second metal and metal oxide layers (where E is the electric field strength and p is the total gas pressure).

2. The lamp of claim 1, wherein said first array of microcavities and said second array of microcavities are aligned.

3. The lamp of claim 1, wherein said first array of microcavities and said second array of microcavities are offset.

4. The lamp of claim 1, further comprising a transparent electrode on an external surface of said packaging.

5. The lamp of claim 1, further comprising a encapsulated metal electrode formed as part of said packaging layer.

6. The lamp of claim 1, further comprising phosphor on an internal surface of said packaging.

7. The lamp of claim 1, wherein said packaging is transparent on front and back sides of said array and said array produces emissions from the front and back sides.

8. The lamp of claim 1, wherein said first and second metal and metal oxide layers are suspended with a gap between them and said first and second metal and metal oxide layers are arranged such that said first array of microcavities and said second array of microcavities are offset.

9. The lamp of claim 1, wherein said first and second metal and metal oxide layers are encapsulated with additional dielectric.

10. The lamp of claim 1, wherein said first and second metal and metal oxide layers are extruded.

11. The lamp of claim 1, wherein said first array of microcavities has a different spacing than said second array of microcavities.

12. A microcavity plasma lamp, comprising:

a first metal and metal oxide layer defining a first array of microcavities and an oxide encapsulated first thin metal electrode;

a second metal and metal oxide layer defining a second array of microcavities and an oxide encapsulated second thin metal electrode, said second metal and metal oxide layer being separated from said first metal and metal oxide layer;

a packaging containing said first and second metal and metal oxide layers; and plasma medium contained within said packaging; wherein said first and second metal and metal oxide layers are configured and arranged to create a varying ratio of electric field strength and total gas pressure (E/p) between the first and second metal and metal oxide layers (where E is the electric field strength and p is the total gas pressure), further comprising a power source, wherein said first and second metal electrodes are driven by said power source, and further comprising a non-driven spacer layer of metal and metal oxide not electrically connected to any power source and containing a third array of microcavities between said first and second thin metal oxide layers.

13. The lamp of claim 12, comprising additional non-driven spacer layers of metal and metal oxide containing additional pluralities of microcavities between said packaging layer and said first and second thin metal oxide layers.

14. The lamp of claim 13, wherein said first, second, third and additional array of microcavities are aligned.

15. The lamp of claim 12, wherein said first, second, and third array of microcavities are aligned.

16. The lamp of claim 15, further comprising separate phosphors on an internal surface of said packaging and aligned with separate columns of microcavities of said first, second and third array of microcavities.

17. The lamp of claim 16, wherein said separate phosphors are screen printed on the internal surface of said packaging.

18. A microcavity plasma lamp, comprising:

a first metal and metal oxide layer defining an array of microcavities and an oxide encapsulated first thin metal electrode;

a second metal and metal oxide layer defining an array of microcavities and an oxide encapsulated second thin metal electrode;

a packaging containing said first and second metal and metal oxide layers; and plasma medium contained within said packaging; wherein said first and second metal and metal oxide layers are configured and arranged to create a varying ratio of electric field strength and total gas pressure (E/p) in the lamp (where E is the electric field strength and p is the total gas pressure), wherein said first and second metal and metal oxide layers are suspended with a gap between at least one of said first and second metal oxide layers and said packaging.

19. The lamp of claim 18, wherein said first and second metal and metal oxide layers are suspended from ends of said first and second metal oxide layers.

20. The lamp of claim 9, wherein said additional dielectric comprises glass.

21. A microcavity plasma lamp, comprising:

a first metal and metal oxide layer defining a first array of microcavities and an oxide encapsulated first thin metal electrode;

a second metal and metal oxide layer defining a second array of microcavities and an oxide encapsulated second thin metal electrode, said second metal and metal oxide layer being separated from said first metal and metal oxide layer;

a packaging containing said first and second metal and metal oxide layers; and plasma medium contained within said packaging; wherein said first and second metal and metal oxide layers are configured and arranged to create a varying ratio of electric field strength and total gas pressure (E/p) between the first and second metal and metal oxide layers (where E is the electric field strength and p is the total gas pressure), further comprising a power source and a non-driven spacer metal and metal oxide layer separating said first and second metal and metal oxide layers, wherein said first and second metal electrodes are driven by said power source and said non-driven spacer metal and metal oxide layer is not electrically connected to any power source.

22. The lamp of claim 21, wherein said non-driven spacer metal and metal oxide layer defines a third array of microcavities.

23. A microcavity plasma lamp comprising a plurality of metal and metal oxide layers defining a plurality of arrays of microcavities and encapsulated thin metal electrodes contained within packaging enclosing a plasma medium and being separated from each other such that there is no direct physical contact between each other and configured and arranged with respect to each other and said packaging medium to create areas having different ratios of electric field strength and total gas pressure (E/p) between adjacent ones of said plurality of metal and metal oxide layers when said thin metal electrodes are driven with a time varying voltage.

24. The lamp of claim 23, comprising gaps between said plurality of metal and metal oxide layers.

25. The lamp of claim 23, comprising additional non-driven space metal and metal oxide layers between said plurality of metal and metal oxide layers.

26. The lamp of claim 23, wherein said plurality of metal and metal oxide layers are extruded.

27. The lamp of claim 23, wherein said plurality of metal and metal oxide layers are encapsulated with additional dielectric.

28. The lamp of claim 27, wherein said additional dielectric comprises glass.

29. A microcavity plasma lamp comprising:

a plurality of metal and metal oxide layers defining a plurality of arrays of microcavities and encapsulated thin metal electrodes and being separated from each other such that there is no direct physical contact between each other;

packaging that packages said plurality of metal and metal oxide layers; and means for varying a ratio of electric field strength and total gas pressure (E/p) between adjacent ones of said plurality of metal and metal oxide layers.

30. A method for manufacturing a microcavity plasma lamp, the method comprising:

providing a plurality of metal and metal oxide layers defining a plurality of arrays of microcavities and encapsulated thin metal electrodes in packaging;

enclosing the packaging between sealed plates;

simultaneously evacuating the volume within the packaging and a volume surrounding the packaging to maintain an insignificant or zero pressure differential across the packaging; and backfilling the packaging with a plasma medium while maintaining an insignificant or zero pressure differential across the packaging.

* * * * *

UNITED STATES PATENT AND TRADEMARK OFFICE

CERTIFICATE OF CORRECTION

PATENT NO. : 8,541,946 B2
APPLICATION NO. : 12/640884
DATED : September 24, 2013
INVENTOR(S) : Eden et al.

It is certified that error appears in the above-identified patent and that said Letters Patent is hereby corrected as shown below:

On the Title Page, Item (75) Inventors:

After "Sung-Jin Park, Champaign, IL", please delete "(US)" and insert --(KR)-- therefor.

In the Specification:

| | |
|---|---|
| Col. 3, line 34 | After "device that", please delete "hand" and insert --has-- therefor. |
| Col. 4, line 15 | Before "small", please delete "a". |

Signed and Sealed this
Sixth Day of May, 2014

Michelle K. Lee

Michelle K. Lee
*Deputy Director of the United States Patent and Trademark Office*